US006308547B1

(12) United States Patent
Heess et al.

(10) Patent No.: US 6,308,547 B1
(45) Date of Patent: Oct. 30, 2001

(54) SHAFT STRAIGHTENING AND HARDENING MACHINE AND WORKPIECE HOLDER THEREFOR

(75) Inventors: Karl Heess, Lampertheim-Hofheim; Karlheinz Schweikert, Buerstadt, both of (DE)

(73) Assignee: Karl Heess GmbH & Co. Maschinenbau, Lampertheim (DE)

( * ) Notice: Subject to any disclaimer, the term of this patent is extended or adjusted under 35 U.S.C. 154(b) by 0 days.

(21) Appl. No.: 09/541,518

(22) Filed: Apr. 3, 2000

(30) Foreign Application Priority Data

Apr. 3, 1999 (DE) ..... 199 15 344

(51) Int. Cl.[7] ..... B21D 3/02
(52) U.S. Cl. ..... 72/107
(58) Field of Search ..... 72/107, 110, 237, 72/238

(56) References Cited

U.S. PATENT DOCUMENTS

| | | | | |
|---|---|---|---|---|
| 720,215 | * | 2/1903 | Barclay | 72/110 |
| 1,045,161 | * | 11/1912 | Machlet | 72/107 |
| 2,748,634 | * | 6/1956 | Koehring et al. | 72/107 |
| 3,785,883 | | 1/1974 | Seulen et al. . | |

FOREIGN PATENT DOCUMENTS

| | | | | |
|---|---|---|---|---|
| 2 427 858 | | 1/1980 | (FR) . | |
| 2 117 296 | * | 10/1983 | (GB) | 72/238 |

OTHER PUBLICATIONS

Wellenricht–und Härtemaschine Modell HR, Hahn & Kolb, Stuttgart, No. 2510/24. (English–language Translation attached).

* cited by examiner

*Primary Examiner*—Lowell A. Larson
(74) *Attorney, Agent, or Firm*—Jacobson Holman, PLLC

(57) ABSTRACT

A shaft straightening and hardening machine, including a holder for a shaft-shaped workpiece, which can be pivoted around an axis which is essentially parallel to the axis of the workpiece. The machine includes a controllable rotary drive for the holder and a coolant bath through which the holder passes as a part of its path of rotation. The holder includes at least one straightening mechanism, which is mounted at a specified point over the length of the workpiece and which acts radially upon the workpiece and can be swung sideways from said workpiece for the purpose of loading and unloading the workpiece. The holder includes several parallel straightening shafts between which the workpiece can be inserted and from which it can be removed. The end face of each straightening shaft is held in a bearing bracket, and one of the straightening shafts can be swung radially sideways. The straightening shafts have radially protruding profiling that act as the straightening elements or mechanisms.

7 Claims, 4 Drawing Sheets

SHAFT STRAIGHTENING AND HARDENING MACHINE AND WORKPIECE HOLDER THEREFOR

BACKGROUND OF THE INVENTION

1. Field of the Invention

The invention relates to a shaft straightening and hardening machine, including a holder for a shaft-shaped workpiece. The holder can be moved circumferentially about an axis, which is essentially parallel to the axis of the workpiece, by a controlled rotary drive mechanism. The machine includes a coolant bath through which the holder passes as part of its path of circumferential or rotary movement. The holder includes at least one straightening shaft having a straightening mechanism or clement thereon, which is mounted at a specified location along the length of the workpiece and which acts radially upon the workpiece and can be swung sideways from said workpiece for the purpose of loading and unloading the workpiece.

2. Description of Related Art

In a prior art shaft straightening and hardening machine (as described in the prospectus from Hahn & Kolb, Stuttgart, No. 2510/24), a shaft-shaped workpiece may be clamped between two headstocks at a loading and unloading station. The machine includes several groups of straightening rolls, which can be moved along a bed parallel to the workpiece axis to specific locations along the length of the workpiece where the workpiece is to be acted upon with a specified or predetermined degree of straightening. To load and unload the workpiece into the machine, a straightening roll of each group of straightening rolls can be swung sideways or radially and the workpiece is loaded into, or unloaded from, the two headstocks. A rotary drive mechanism conveys the holder with the assigned straightening rolls through the coolant bath, usually an oil bath, for the purpose of workpiece quenching. After emerging from the oil bath, the hardened workpiece is removed from the headstocks after the straightening rolls have been swung out. The straightening rolls or rollers are substantially disc-shaped and results in relatively point by point straightening of the workpiece which can have an undesired negative impact on the workpiece, if the workpiece exhibits one or more axial, optionally also eccentric boreholes. The object of the present invention is to improve this type of machine.

SUMMARY OF THE INVENTION

The invention provides for a shaft straightening and hardening machine of the type described above but with a novel workpiece holder arrangement, including straightening mechanisms, comprising several parallel straightening shafts between which the workpiece can be inserted and from which the workpiece can be removed. The workpiece holder arrangement may be mounted on the known shaft straightening and hardening machine. The end face of each straightening shaft is held in a bearing bracket and one of the straightening shafts can be swung radially sideways or outwardly. The straightening shafts include radially protruding profiling that form the straightening mechanisms or elements. The loading and unloading of the workpiece is significantly simplified by the invention and thus accelerated because a workpiece needs only to be expediently inserted between or removed from two fixed straightening shafts without having to adjust the bearing brackets. As a result, the bearing brackets can be mounted stationarily to the machine for circumferential movement therewith. In addition, the straightening mechanisms formed by suitable profiling of the straightening shafts may be machined outside the machine which provides great simplicity particularly if several points or areas of the workpiece are to be straightened along the workpiece. For a specific type of workpiece only one set of straightening shafts is necessary. They are clamped into the bearing brackets and remain there independently of the changing of the workpieces. For those workpieces provided with one or more axial boreholes, the invention is especially advantageous if the profiling exhibit a relatively large axial length.

DESCRIPTION OF PREFERRED EMBODIMENTS

Figure 1:
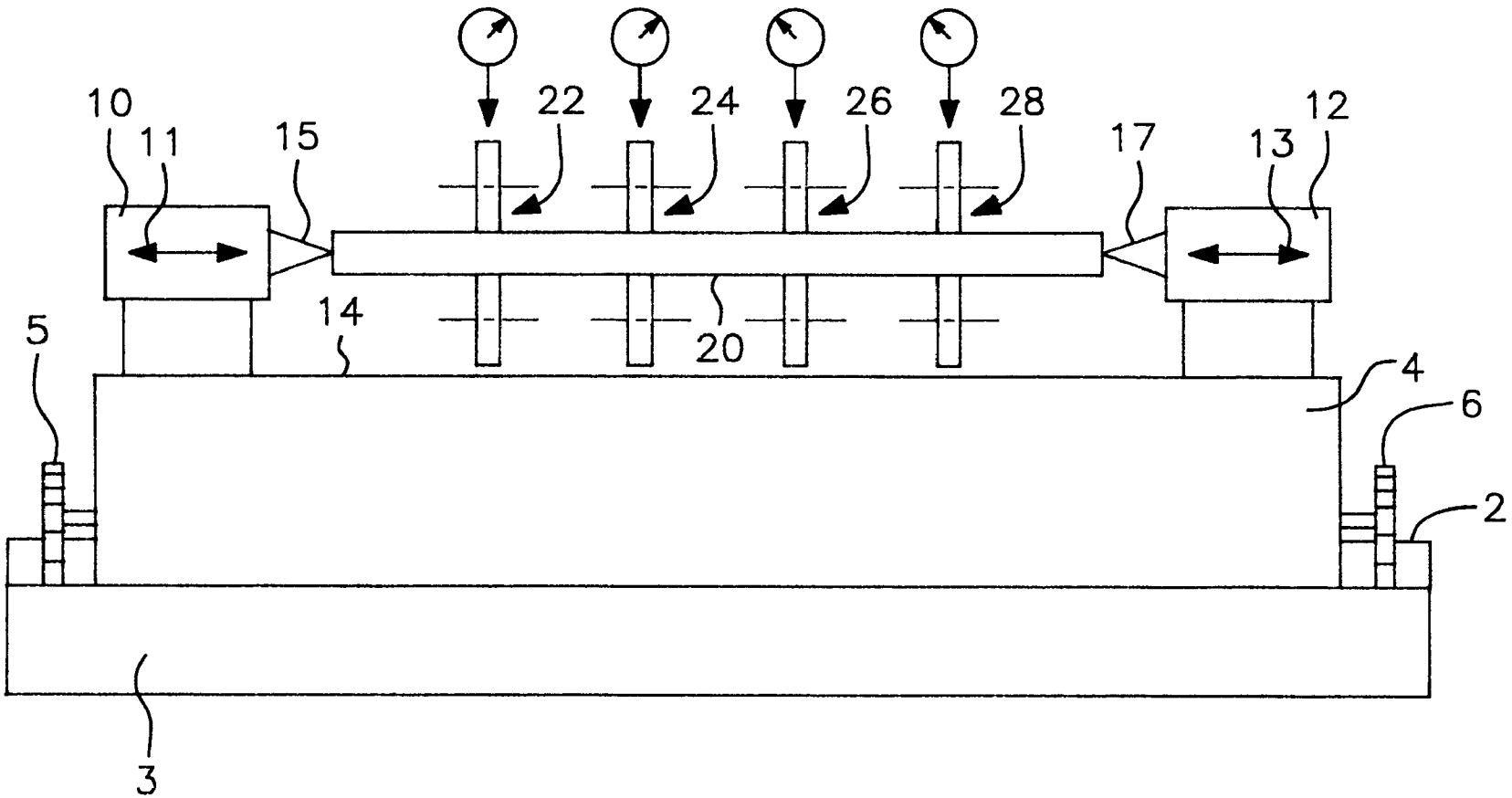
FIG. 1 is a schematic drawing of a known shaft straightening and hardening machine including the prior holder arrangement and straightening mechanisms in the form of the prior art straightening rolls for straightening a shaft-shaped workpiece.

The known shaft straightening and hardening machine, which is depicted as a schematic drawing in FIG. 1 and is labeled 1 in its entirety, includes a basin 2 containing oil 3 as coolant and a drum 4, which can be rotated (not illustrated) in the basin. The basin 2 is shown only in part and the depth is shown reduced. Similarly the bottom of the rotatable drum 4 is not shown since it is submerged within the oil 3 within the basin 2. Each side or end of the drum 4 is coupled to a rotary drive motor by means of chain gears 5, 6 respectively or any other well-known drive mechanisms. The top portion or periphery of the drum 4 that is shown rising above the oil 3 shows near the two ends a pair of headstocks 10, 12, mounted on a bed 14 that is part of the drum, the headstocks movable on the bed 14 on the top of the drum 4. The headstocks are movable in the direction of the two double arrows 11, 13. Between two lathe centers 15, 17, which face each other, the prior art machine 1 mounts a shaft shaped workpiece 20, which is rotated by at least one motor coupled to one of the headstocks 10, 12. Over the length of the workpiece 20 the illustrated embodiment depicts four groups of straightening rolls 22, 24, 26, 28 arranged at specific points or locations along the length of the workpiece 20 on the bed 14. At these locations, the workpiece 20 is to be straightened. Each group of straightening rolls 22, 24, 26, 28 comprises in the conventional manner three straightening rolls, which are uniformly distributed in the circumferential direction and act radially upon the workpiece 20 in proportion to the pressure that is set, as is known in the art. After the workpiece in the shaft straightening and hardening machine as shown in FIG. 1 is straightened, the drum 4 is rotated or moved circumferentially in such a manner around an axis parallel to the axis of the workpiece 20 using a rotary drive mechanism (not illustrated) so that the warm, optionally red hot, workpiece 20 is submerged into the oil 3 and quenched there. The drum 4 continues to rotate to move the quenched workpiece out of the oil for removal from the machine.

It is clear that the workpiece holder of the prior art shaft straightening and hardening machine 1 is formed by the headstocks 10, 12 and the related lathe centers 15, 17, whereby to insert the workpiece 20 the uppermost straightening rolls of each group of straightening rolls must be swung sideways. It is apparent that the straightening mechanisms for the workpiece 20 are formed from the group of straightening rolls 22, 24, 26, 28.

The present invention relates to a novel workpiece holder mechanism that includes straightening mechanisms, i.e. straightening elements, for a straightening and hardening machine of the type shown in FIG. 1. Recording to FIGS. 2 to 4, the holder 50 for a shaft-shaped workpiece 30 comprises three parallel straightening shafts 42, 44, 46. Each of the straightening shafts 42, 44, 46 is held at its end faces in a straightening shaft gripper, formed as a lathe center, in such a manner that the straightening shafts cannot move axially. In particular the first straightening shaft 42 is held between lathe centers 41 and 43; the second straightening shaft 44, between the lathe centers 45 and 47; and the third straightening shaft 46, between the lathe centers 49 and 51 (FIG. 4). Each lathe center protrudes beyond a bearing bracket. In particular, the lathe center 41 protrudes beyond the bearing bracket 52; the lathe center 43, beyond the bearing bracket 54; the lathe center 45, beyond the bearing bracket 56; the lathe center 47, beyond the bearing bracket 58; the lathe center 49, beyond the bearing bracket 60; and finally lathe center 51, beyond the bearing bracket 62. The bearing brackets 52, 54 and 56, 58, provided to hold the straightening shafts 42 and 44, are fastened stationarily (for example fixed on the bed 14 of FIG. 1) on the bed of the shaft straightening and hardening machine. One end of each bearing bracket 60 and 62 is mounted on a swivel arm 61, 63 respectively, which can be hinged to the drum 4 at a convenient location such as the bed 14 so as to pivot around an axis 100 parallel to the axis of the straightening shaft 46. The pivot mechanism may be similar to that described in the art to move the straightening rolls to enable removal of the workpiece as described above with respect to FIG. 1, or any other means for pivoting.

In the illustrated embodiment, the bearing brackets 54, 58, 62, mounted on one side of the machine, house controlled traversing mechanisms, which permit the lathe centers 43, 47, 51 to be moved translatorily in the axial direction as shown schematically in FIG. 4. Traversing mechanisms are generally known to those skilled in the art and could include a rotary drive motor coupled to a gear or screw, or a hydraulic or pneumatic drive system. 30 The lathe centers 43, 47, 51 can be moved sufficiently outwardly by means of the traversing mechanisms so that the straightening shafts 42, 44, 46 can be inserted and removed between the respective lathe centers by any convenient means such as elevating or lifting units (not illustrated). In operation the straightening shafts 42, 44, 46 are fixedly connected to the respectively driven lathe centers 41, 45, 49 so as to be rotatable therewith when the lathe centers 41, 45, 49 are driven by a rotation mechanism (not shown) within the associated bearing blocks 52, 56, 60. The respectively opposite lathe centers 43, 47, 51 are provided with the requisite rotational free run so that the straightening shafts 42, 44, 46 freely rotate when driven by the rotation mechanisms.

Figure 2:
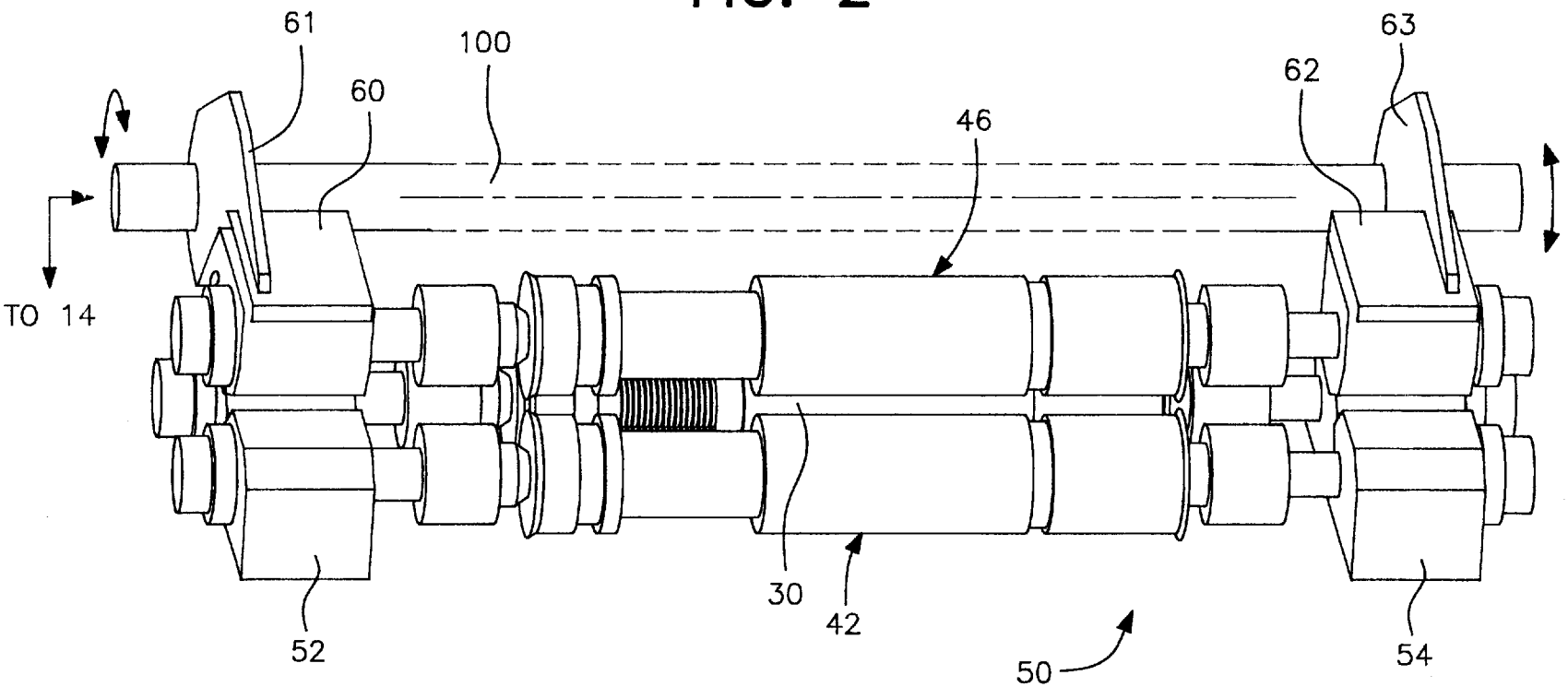
FIG. 2 depicts a workpiece holder of the present invention which comprises three profiled straightening shafts and the inserted shaft-shaped workpiece.
Figure 3:
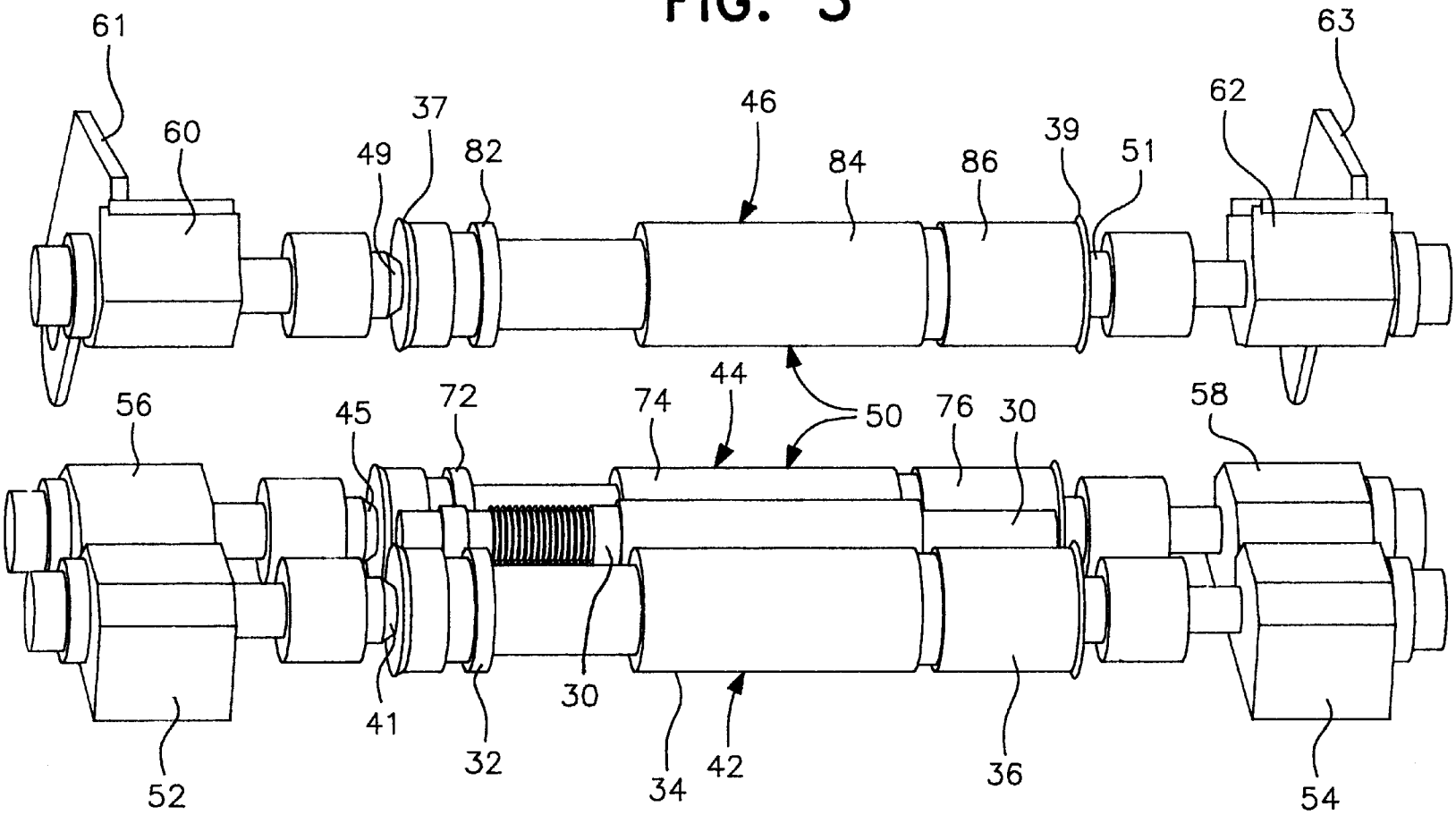
FIG. 3 depicts the workpiece holder of FIG. 2 in an opened state with the workpiece lying inside.
Figure 4:
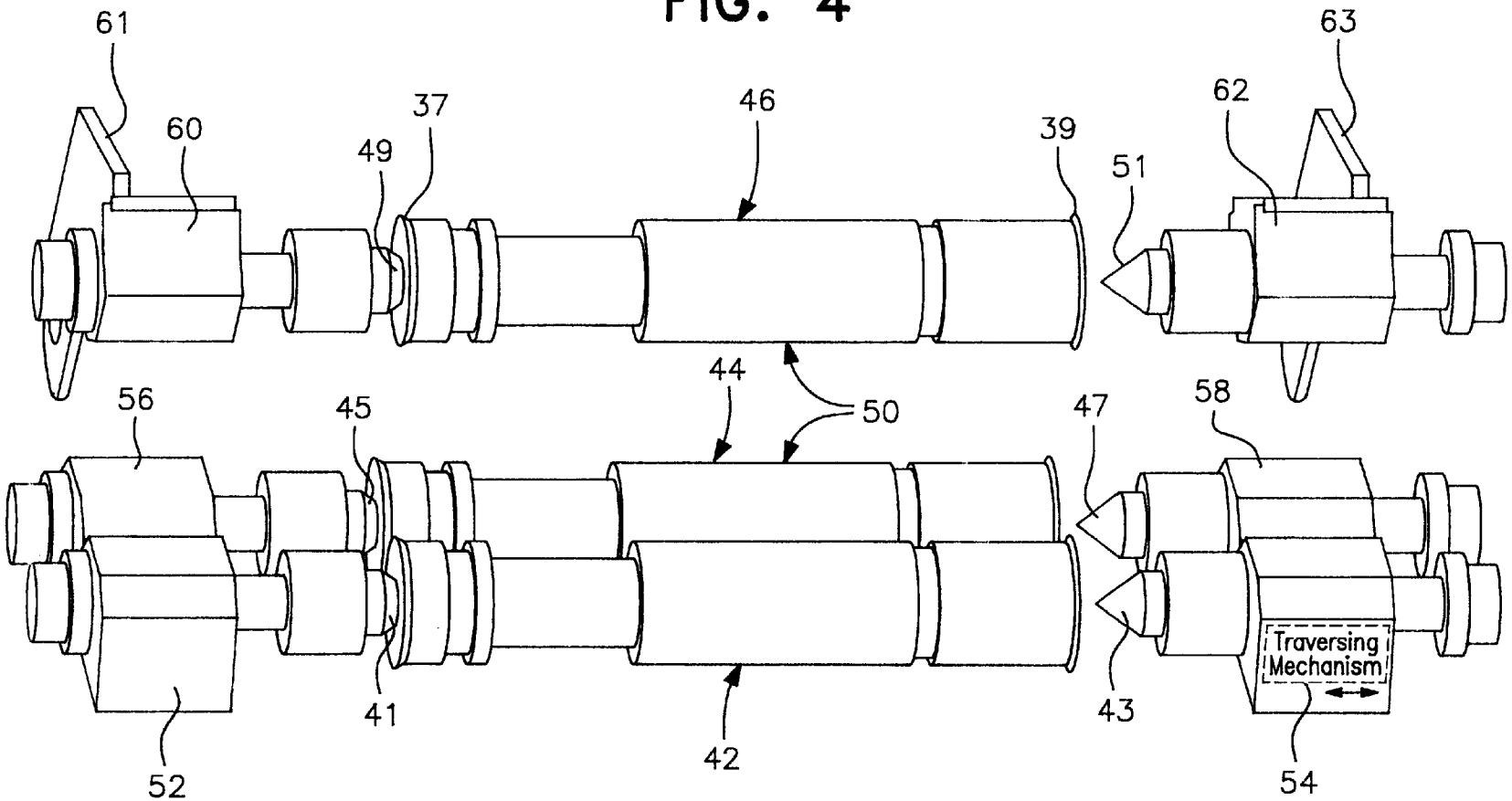
FIG. 4 depicts an open workpiece holder with the straightening shafts recording to FIGS. 2 and 3, where the right hand straightening shaft grippers are retracted to the side.

If the swivel arms 61, 63, recording to FIGS. 3 and 4, are moved in such a manner in the loading and unloading station (not illustrated in detail) of the shaft straightening and hardening machine of the invention, that the straightening shaft 46 is lifted far enough away from the two non-moveable straightening shafts 42, 44, the workpiece 30 can be inserted, recording to FIG. 3, into the slot or gap between the two straightening shafts 42, 44 using the lifting or elevating units (not shown). The upper straightening shaft 46 is then lowered so that the workpiece 30 is caught, i.e. captured, as shown in FIG. 2, by the three straightening shafts 42, 44, 46 and can be acted upon radially with the desired straightening pressure by suitably actuating the arms 61, 63. The imposition of straightening pressure upon rolls is known in the art and similar arrangements may be used herein.

It must also be noted that to ensure the correct axial seating of the workpiece 30, each straightening shaft 42, 44, 46 exhibits on its side face a radially protruding collar, which for the straightening shaft 46 is labeled 37, 39 so that the workpiece 30 remains caught in a defined axial position between the collars 37, 39.

The straightening mechanisms, i.e. straightening elements, of the present invention are defined by appropriate profiling on the outer shell surface of each of the straightening shafts 42, 44, 46. Thus, the straightening shaft 42 shows at a predetermined specific location a first radially protruding straightening ring 32, which acts directly upon the workpiece 30 at the desired location. Over another region of the workpiece length, a relatively wide straightening ring 34 is formed; and a third straightening ring 36 of the straightening shaft 42 makes contact with the final segment of the workpiece 30. Correspondingly straightening rings 72, 74, 76 (on the straightening shaft 44) and 82, 84, 86 (on the straightening shaft 46), which are in exact alignment with the straightening rings 32, 34, 36 relative to the longitudinal direction of the workpiece 30, are formed on the straightening shafts 44, 46. The position of the straightening rings relative to the length of the workpiece 30 and the width of the straightening rings is not subject to any restrictions on the straightening shafts 42, 44; rather the dimensions can be selected in such a manner that the workpiece 30 can be straightened as desired.

It is thus apparent that the straightening shafts 42, 44, 46 can remain clamped between the related lathe centers as long as the same type of workpiece is to be straightened and hardened. As long as the type of workpiece 30 remains the same, there is no need to further adjust the machine; one need only insert the hot workpiece 30 into the holder 50, close the holder 50 by pivoting straightening shaft 46 against the workpiece 30 and exert pressure on the workpiece, rotate the drum so that the straightening shafts 42, 44, 46 with the workpiece 30 pass through the oil bath to be quenched, and finally to remove the workpiece 30 from the holder 50 again by opening the holder 50.

What is claimed is:

1. A shaft straightening and hardening machine including a holder for holding a shaft-shaped workpiece, the holder movable about an axis parallel to the axis of the workpiece by a controllable rotary drive mechanism, and a coolant bath through which the holder passes through part of its path of movement, the holder comprising a set of plural parallel straightening shafts positioned to define a space between which a shaft-shaped workpiece is insertable and removable, said workpiece being entirely supportable within the holder by said set of straightening shafts, each of said plural parallel straightening shafts removably connected with the holder to enable said set to be removed and exchanged with another set of plural parallel straightening shafts, each straightening shaft within a set including end faces wherein each end face of each straightening shaft is held in a bearing bracket, whereby one of said straightening shafts within a set is swingable to an open position to enable insertion and removal of the workpiece, at least one of said straightening shafts within a set acting radially on the workpiece to exert pressure thereon, and wherein each of said straightening shafts include radially protruding profiling that form straightening elements for straightening the workpiece, said profiling of the straightening shafts within a set are predetermined circumferentially oriented, radially protruding rings about said straightening shafts and of predetermined axially extending lengths along the length of said straightening shafts, the radial and axial dimensions predetermined in accordance with the workpiece to be straightened, and wherein a set of straightening shafts are removable and exchangeable with other sets of straightening shafts of different predetermined radial and axial protruding ring dimensions to enable the straightening of workpieces of varying profiles.

2. The machine as claimed in claim 1 wherein said swingable straightening shaft is swung open by a pair of swivel arms each of which are coupled between the bearing bracket that holds the swingable straightening shaft and the machine wherein said swivel arms swivel around an axis parallel to the axis of the straightening shaft.

3. The machine as claimed in claim 1 further comprising a straightening shaft gripper for gripping each straightening shaft and extending from a bracket, each bearing bracket associated with each said gripper including controllable traversing mechanisms for moving the straightening shaft gripper axially so that by retracting the straightening shaft gripper, the straightening shafts may be inserted or removed.

4. The machine as claimed in claim 3, wherein said straightening shaft grippers are lathe centers.

5. The machine as claimed in claim 3 wherein the bearing brackets are fastened stationarily to the machine.

6. The machine as claimed in claim 1 wherein each straightening shaft includes a radially protruding collar at an end face.

7. The machine as claimed in claim 1 wherein said holder includes two stationary straightening shafts and a straightening shaft that can be swung sideways.

* * * * *